United States Patent [19]

Grass

[11] Patent Number: 4,756,387

[45] Date of Patent: Jul. 12, 1988

[54] STAIRCASE LIFT

[76] Inventor: Gerd Grass, Talstr. 16, D-4930 Detmold, Fed. Rep. of Germany

[21] Appl. No.: 9,279

[22] Filed: Jan. 30, 1987

[30] Foreign Application Priority Data

Jan. 30, 1986 [DE] Fed. Rep. of Germany ..... 3602770

[51] Int. Cl.[4] ..... B66B 17/12

[52] U.S. Cl. ..... 187/12; 182/37

[58] Field of Search ..... 187/12, 13, 14, 6, 10, 187/24, 25; 182/36, 37

[56] References Cited

FOREIGN PATENT DOCUMENTS 0043592 1/1982 European Pat. Off. ..... 187/12

3504854 8/1986 Fed. Rep. of Germany ..... 187/12

*Primary Examiner*—Joseph J. Rolla

*Assistant Examiner*—Kenneth Noland

*Attorney, Agent, or Firm*—Herbert L. Lerner; Laurence A. Greenberg

[57] ABSTRACT

A staircase lift includes upper and lower support girders fixedly disposed along stairs, vertical rods disposed between the support girders, inclined support rods fixed on the vertical rods, a load receiver in the form of a platform or a seat with a back panel, the load receiver being movably supporting on the upper and lower support girders, a flat drive housing disposed on the back panel of the load receiver, and a motor-driven drive disposed in the drive housing, the drive including bolts having ends supported in endless grooves formed in the drive housing, a closed endless circle of guide sleeves supported on the bolts, a pair of gear wheels driving the bolts, and a plurality of support rollers equidistantly disposed in the circle of guide sleeves, extending from the drive housing and cooperating with the bolts.

9 Claims, 3 Drawing Sheets

1
2
4
4
4
4
6
6
6
14
15
16
26
29
26
29
26
29

STAIRCASE LIFT

The invention relates to a staircase lift or stair glider with a load receiver in the form of a platform or a seat which is movably supported on upper and lower support girders fixedly disposed along stairs and is equipped with a motor-driven drive.

A staircase lift of the type used as a lift for the handicapped is already known from European Pat. No. 00 19 014. Besides an upper and a lower support girder for the support of a load receiver, a first embodiment of that device uses a guidance girder acted upon by two support rollers in a bearing bracket guided on a drive spindle by means of a spindle nut. The staircase lift can be moved along the support girders by changing the height of the support rollers with the spindle nut. In a second embodiment of the device, vertical rungs are provided at equal distance between the support girders instead of the guidance girder and a segmented plate is fixed at about the center of each of the vertical rungs between the support girders. As in the first embodiment, a vertical drive spindle with a worm gear is disposed on the lift and cooperates with horizontally disposed ribs on the segmented plates. The ribs on the segmented plates form a sort of reeled off or unwound worm gear and when the driven spindle is turned, they result in a height displacement of the lift and therefore a forced movement along the support girders.

These conventional structures are comparatively expensive and require considerable effort to give the required stiffness to the transport frame formed by the support girders and the guidance girder or the rungs with the segmented plates.

It is accordingly an object of the invention to provide a staircase lift, which overcomes the hereinafore-mentioned disadvantages of the heretofore-known devices of this general type and to develop a new drive system having an inherently greater stiffness with less effort, which permits a space-saving installation in existing stairways. A special object of the device is to ensure that the desired speed of the lift in each case is only determined by the inclination of the support rods while no mechanical interference with the gear or with the rpm of the drive motor is required. It is also an object to avoid the higher speed of the prior art chair lifts around curves and to reduced the speed in a desirable manner.

With the foregoing and other objects in view there is provided, in accordance with the invention, a staircase lift or stair glider, comprising upper and lower support girders or wales fixedly disposed along stairs, vertical rods disposed between the support girders, inclined support rods fixed on the vertical rods, a load receiver in the form of a platform or a seat with a back panel, means for movably supporting the load receiver on the upper and lower support girders, a flat drive housing disposed on the back panel of the load receiver, and a motor-driven drive disposed in the drive housing, the drive including bolts having ends supported in endless grooves formed in the drive housing, a closed endless circle or series of guide sleeves supported on the bolts, a pair of gear wheels driving the bolts, and a plurality of support rollers equidistantly disposed in the circle of guide sleeves, extending from the drive housing and cooperating with the bolts.

In accordance with another feature of the invention, the vertical rods are equidistantly disposed between the support girders.

In accordance with a further feature of the invention, the inclined support rods are overlappingly disposed on the vertical rods and two of the inclined support rods are disposed in parallel one above the other between each two of the vertical rods.

In accordance with an added feature of the invention, the pair of gear wheels have teeth acting on the ends of the bolts, and including a drive of the pair of gear wheels moving the bolts with the guide sleeves in a given rotation direction.

In accordance with an additional feature of the invention, there are provided bolt stubs each being disposed in front of and fixedly connected to two respective guide sleeves, and rectangular steel pieces fastened on the bolt stubs, the support rollers being pivotally supported on the rectangular steel pieces.

In accordance with yet another feature of the invention, the vertical rods are equally offset over a main part of the length thereof in direction towards a stairwell.

In accordance with yet a further feature of the invention, the at least two of the support rollers actively cooperate with the inclined support rods.

In accordance with yet an added feature of the invention, the drive housing has upper and lower ends, and the movable supporting means are in the form of pivotally disposed roller cages each being connecting to a respective one of the ends of the drive housing, and guide rollers disposed in the pivotally disposed roller cages and supported on the upper and lower support girders.

In accordance with a concomitant feature of the invention, the guide rollers are in the form of two pairs of or $2\times2$ guide rollers pivotably supported in each roller cage.

Other features which are considered as characteristic for the invention are set forth in the appended claims.

Although the invention is illustrated and described herein as embodied in a staircase lift, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
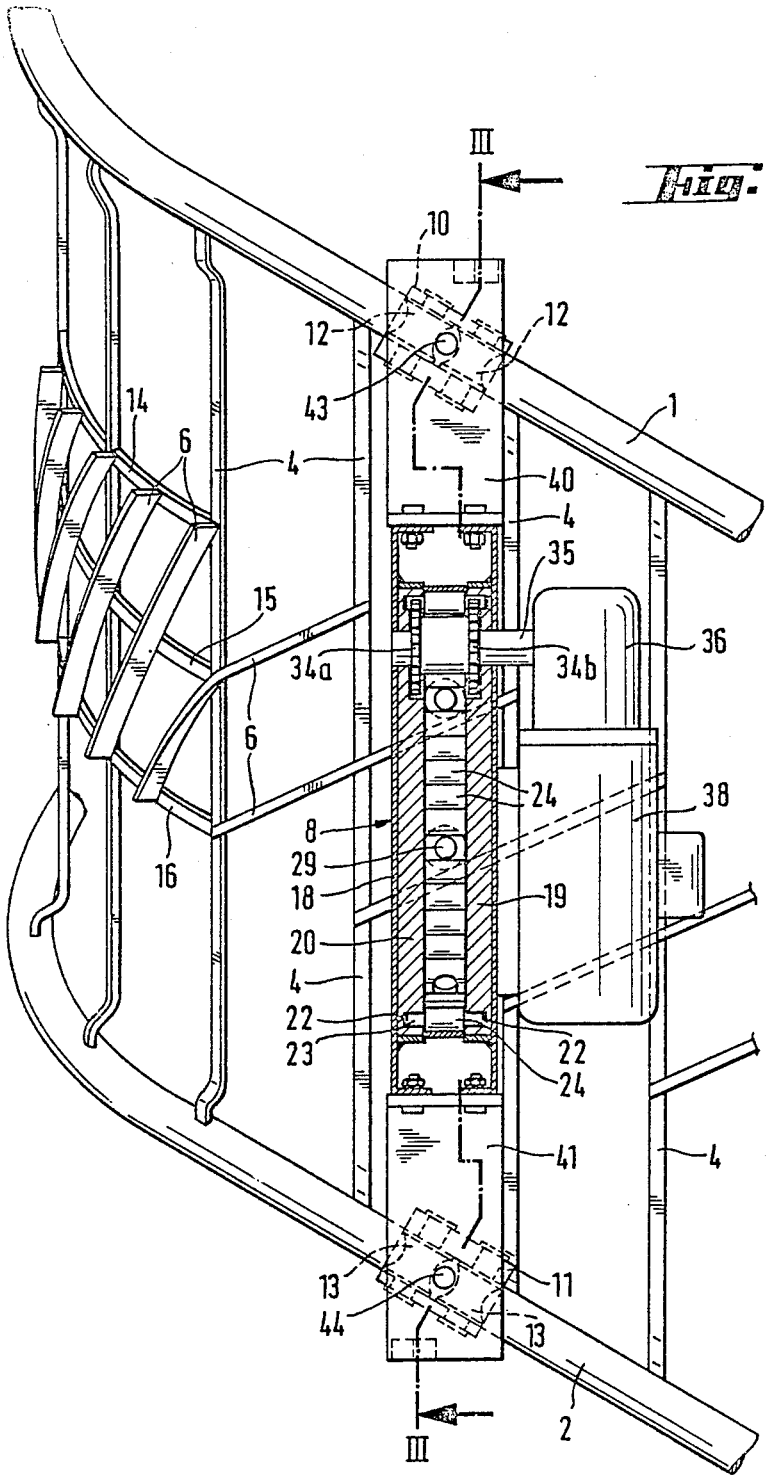
FIG. 1 is a fragmentary, diagrammatic perspective view of a transport frame and a drive part of a load receiver which is partially in section.

Referring now to the figures of the drawings in detail and first, particularly, to FIG. 1 thereof, it is seen that the stair glider or staircase lift is mainly formed of an upper support girder or wale 1, which can simultaneously serve as handrail of a banister, a lower support girder or wale 2, which is placed closely above the stair steps on the stairwell side, vertical rods 4 disposed between the two support girders 1 and 2, inclined support rods 6 fixed to a central part of the vertical rods 4 and a load receiver 8 with a motor drive and upper and lower roller cages 10, 11 each having two pairs of guide rollers 12 for guiding the load receiver along the support girders 1 and 2. The lift or elevator itself is not shown. The support girders 1 and 2 have the same dimensions and are in the form of pipes disposed in parallel on top of each other, with the diameter thereof depending on the load capability of the staircase lift. The vertical rods 4 fixed between the support girders 1 and 2 are placed are regular intervals and are evenly offset along the main part of the length thereof towards the staircase lift, which provides space for the drive of the load receiver.

The inclined support rods 6 normally extend in the region of the non-illustrated stair steps between three vertical rods 4, as shown at the right part of FIG. 1. In the transition region, such as from the top steps of a stair to a level landing, the inclination of the support rods 6 is made steeper, so that the support rods only extend across the region between two vertical rods 4 or across only part of a region, as suggested at the left part of FIG. 1. In order to assure the stiffness and stability of the support rods in this case, additional support rods 14 to 16 are provided which run parallel to the support girders.

Figure 3:
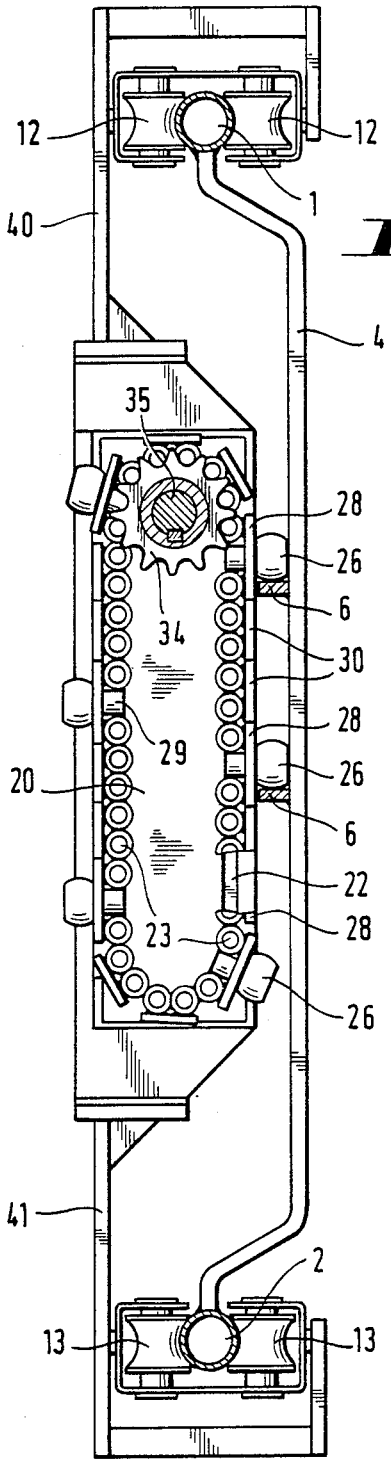
FIG. 3 is a simplified sectional view taken along the line III—III of FIG. 1.

The drive which is disposed in a drive housing 18, may be formed of two guide plates 19 and 20 which are 2 cm thick. An endless groove 22 in the form of a slender "0" has been cut into each guide plate to a depth of approximately 1.5 cm, as is also shown in FIG. 3. The groove is semicircular at upper and lower sections thereof and it is straight on both sides. The two guides plates 19 and 20 are identical and are disposed in the drive housing 18 shown in FIG. 1 at a spacing of 3 cm, for example, in such a way that the grooves on the inside are exactly opposite one another. Guide sleeves 24 are pivotally placed on bolts 23, have lengths exactly adapted to the distance between the guide plates 19 and 20, are disposed in the grooves 22 in a closed, endless circle or series. The diameter of the bolts 23 corresponds to the width of the grooves 22.

As seen in FIG. 3, six support rollers 26 are equidistantly disposed in the closed, endless circle of the guide sleeves 24 placed on the bolts 23. The support rollers 26 extend from the drive housing 18 and are pivotally disposed on bolt stubs 29 seen in FIG. 1, which are fixed on rectangular steel pieces 28 seen in FIG. 3. The rectangular steel pieces 28 are each disposed in front of of two guide sleeves 24 and are fixedly connected therewith. The remainder of the guide sleeves provided next to the rectangular steel pieces 28 are fixedly connected with smaller rectangular steel pieces 30 in pairs and are used for lateral support of the rectangular steel pieces 28 which bear the support rollers 26, in the vicinity of the straight vertical groove 22.

The drive of the endless circle of guide sleeves 24 disposed on the bolts 23 is effected by means of a gear wheel pair 34, which is formed of gear wheels 34*a* and 34*b* disposed in the upper part of the drive housing 18, the shape of the teeth thereof conforming to the diameter of the bolts 23 seen in FIGS. 1 and 3. The gear wheel pair 34 is fixedly connected with a drive shaft 35 of a reduction gear 36 disposed in the guide plates 19 and 20 within the drive housing 18. The reduction gear 36 and a motor 38 are disposed on the side of the drive housing 18.

The upper and lower ends of the drive housing 18 are screwed to respective upper and lower angled supports 40 and 41. The upper angled support 40 and the lower angled support 41 have the respective roller cages 10 and 11 at the free ends thereof. The upper roller cage 10 is pivotally supported by means of a pivot shaft 43 and the lower roller cage 11 is pivoted on a pivot shaft 44. The load receiver 8 can be moved up or down on the support girders 1 and 2 by means of the guide rollers 12 and 13 which are pivotally supported in the roller cages 10 and 11. The pivotable support of the roller cages 10 and 11 permits the roller guidance to continuously conform to the varying inclination of the support girders 1 and 2. Four guide rollers 12 and 13 are disposed in the roller cages 10 and 11 in such a way that two guide rollers 12 or 13 are disposed opposite each other on both sides of the support girders.

Figure 2:
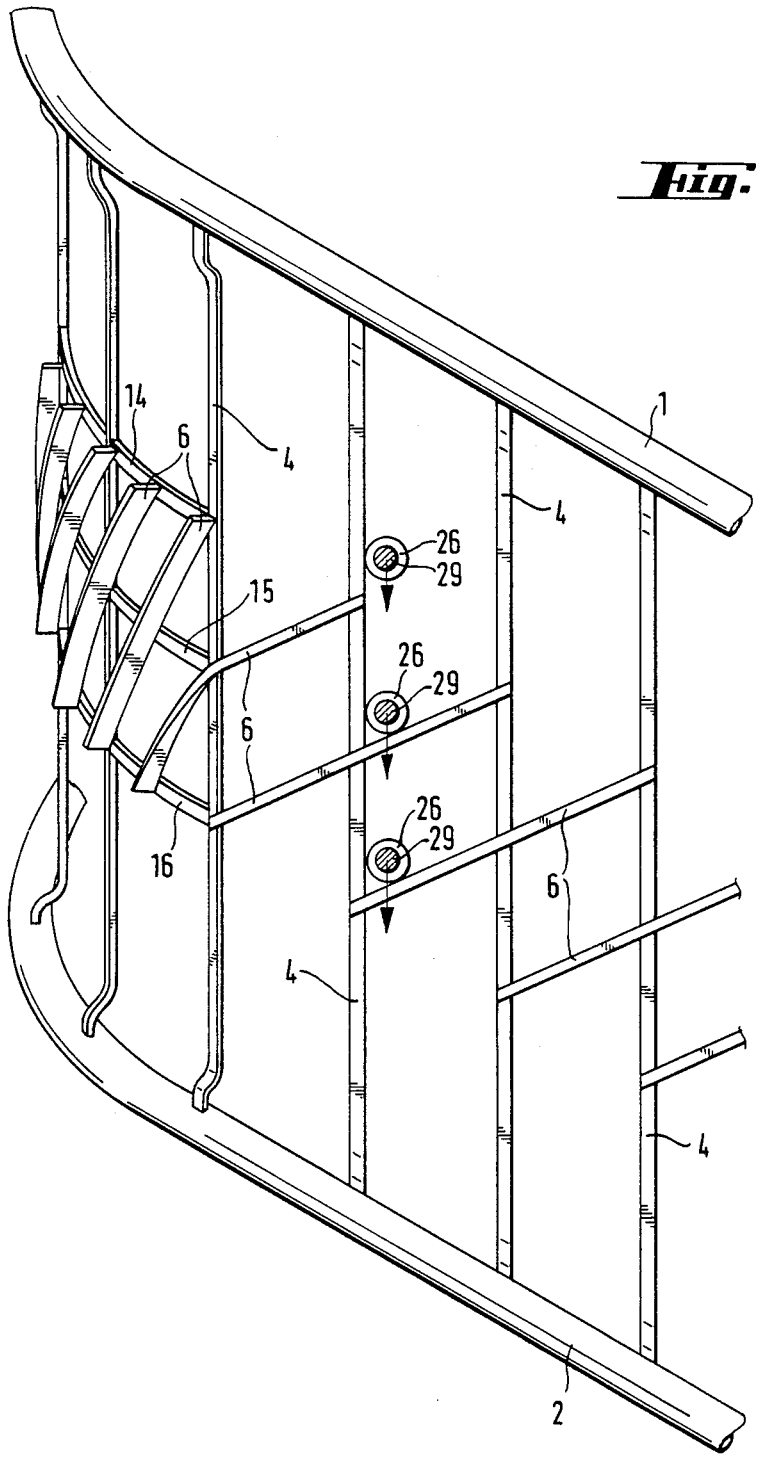
FIG. 2 is another fragmentary perspective view of the transport frame with a simplified illustration of a possible disposition of support rollers on inclined support rods.

As can be seen from FIG. 2, the inclined support rods 6 are overlappingly disposed in such a manner that two inclined support rods 6 are respectively placed on top of each other in each region between the vertical rods. This assures that there are always at least two support rollers 26 engaged with the inclined support rods 6 during the movement of the load receiver 8 along the path formed by the support girders 1 and 2.

As the gear wheel pair 34 forces a support roller 26 to bear downward against a support rod 6 in the direction of the arrows shown in FIG. 2, the load receiver 8 will be forced upward. As the support roller 26 moves along the path thereof shown in FIG. 3 toward the bottom of FIG. 3 and toward the bottom of FIG. 2, it will be raised above the plane of FIG. 2 and therefore away from all of the support rods 6, until it approaches the plane of the support rods 6 again, toward the top of FIG. 2.

The foregoing is a description corresponding in substance to German Application P No. 36 02 770.7, dated Jan. 30, 1986, the International priority of which is being claimed for the instant application, and which is hereby made part of this application. Any material discrepancies between the foregoing specification and the aforementioned corresponding German application are to be resolved in favor of the latter.

I claim:

1. Staircase lift, comprising upper and lower support girders fixedly disposed along stairs, vertical rods disposed between said support girders, inclined support rods fixed on said vertical rods, a load receiver in the form of a platform or a seat with a back panel, means for movably supporting said load receiver on said upper and lower support girders, a flat drive housing disposed on said back panel of said load receiver, and a motor-driven drive disposed in said drive housing, said drive including bolts having ends supported in endless grooves formed in said drive housing, a closed endless circle of guide sleeves supported on said bolts, a pair of gear wheels driving said bolts, and a plurality of support rollers equidistantly disposed in said circle of guide sleeves, extending from said drive housing and cooperating with said bolts, said pair of gear wheels forcing at least one of said plurality of support rollers on one of said inclined support rods to thereby force said load receiver upward.

2. Staircase lift according to claim 1, wherein said vertical rods are equidistantly disposed between said support girders.

3. Staircase lift according to claim 2, wherein said inclined support rods are overlappingly disposed on said vertical rods and two of said inclined support rods are disposed in parallel one above the other between each two of said vertical rods.

4. Staircase lift according to claim 1, wherein said pair of gear wheels have teeth acting on said ends of said bolts, and including a drive of said pair of gear wheels moving said bolts with said guide sleeves in a given rotation direction.

5. Staircase lift according to claim 1, including bolt stubs each being disposed in front of and fixedly connected to two respective guide sleeves, and rectangular steel pieces fastened on said bolt stubs, said support rollers being pivotally supported on said rectangular steel pieces.

6. Staircase lift according to claim 1, wherein said vertical rods are equally offset over a main part of the length thereof in direction towards a stairwell.

7. Staircase lift according to claim 1, wherein at least two of said support rollers actively cooperate with said inclined support rods.

8. Staircase lift according to claim 1, wherein said drive housing has upper and lower ends, and said movable supporting means are in the form of pivotally disposed roller cages each being connecting to a respective one of said ends of said drive housing, and guide rollers disposed in said pivotally disposed roller cages and supported on said upper and lower support girders.

9. Staircase lift according to claim 8, wherein said guide rollers are in the form of two pairs of guide rollers pivotably supported in each roller cage.

* * * * *